US006127008A

United States Patent [19]

Ingebrigtson

[11] Patent Number: 6,127,008

[45] Date of Patent: Oct. 3, 2000

[54] SWINGER ARTICLE AND METHOD

[75] Inventor: Daniel L. Ingebrigtson, Franklin, Wis.

[73] Assignee: Accents Unlimited, Inc., Milwaukee, Wis.

[21] Appl. No.: 09/347,982

[22] Filed: Jul. 6, 1999

[51] Int. Cl.[7] ..... A63G 31/00

[52] U.S. Cl. ..... 428/16; 47/33; 116/22 A

[58] Field of Search ..... 428/16; 116/22 A; 47/33; 472/118

[56] References Cited

PUBLICATIONS

Supplementary Registration Application dated Jun. 8, 1999 and attached Copyright Registration VA 931–195 dated Aug. 25, 1998.

Supplementary Registration Application dated Jun. 8, 1999 and attached Copyright Registration VA 931–200 dated Aug. 25, 1998.

Supplementary Registration Application dated Jun. 8, 1999 and attached Copyright Registration VA 931–194 dated Aug. 25, 1998.

Supplementary Registration Application dated Jun. 8, 1999 and attached Copyright Registration VA 931–201 dated Aug. 25, 1998.

*Primary Examiner*—Alexander S. Thomas

*Attorney, Agent, or Firm*—Collard & Roe, P.C.

[57] ABSTRACT

An article of manufacture adapted to swing from a supporting structure, such as a tree or a post, and a method of providing the appearance of a figure on a swing is provided. The article includes a base having top and bottom surfaces comprising first and second rectilinear parallel sides and third and fourth sides transverse to and having imaginary juncture lines with the rectilinear sides. At least two base holes extend through the base. A body in the shape of a figure is connected to the base. The body has at least two body holes extending through the body which are aligned with the base holes. Each of the body holes have an upper portion and a lower portion. The lower portions of the body holes are disposed in a horizontal plane parallel to the top and bottom surfaces of the base. Swing means for suspending the article from the supporting structure, such as a rope, cord or metal cable, passes through the base holes and the body holes to permit swinging movement of the article and, along with the base and body, provide the appearance of a figure on a swing.

11 Claims, 4 Drawing Sheets

SWINGER ARTICLE AND METHOD

BACKGROUND OF THE INVENTION

1. Field of the Invention

The present invention relates to indoor/outdoor articles of manufacture and, more particularly, to swinging structures used, for example, to repel animals and birds and for decorative purposes, and methods of providing the appearance of a figure on a swing.

2. The Prior Art

At the present time there are a large variety of commercially available sculptures which may be used as key keepers, statuary and candleholders. For example, one type of animal-shaped structure is formed from pre-cast gypsum plaster and consists of a sculpture in the shape of an animal such as a rabbit, a squirrel, or a duck. In addition it is known to equip figures such as frogs with citronella candles to keep bugs away from a patio or deck. It is also known to form planters in the shape of a frog having feet which serve to raise the rest of the planter, including the flower pot in the planter, off the deck or porch. However, there is still a need for an article of manufacture which is adapted to swing from supporting structures such as trees, posts, etc. and to a method of providing the appearance of a figure on a swing.

OBJECTIVES AND FEATURES OF THE INVENTION

It is an objective of the present invention to provide swinging articles of manufacture which may be suspended from a variety of available structures, so that they may be used by homeowners, for example, to give a different look to gardens, patios, and backyards with limited space and without damaging plants or taking up soil space where flowers would otherwise grow.

It is a further objective of the present invention to provide such an article which may be formed of an inexpensive material, such as concrete or concrete derivatives, and yet will provide an attractive figure for homeowners to use to deter birds from approaching a garden.

It is a further feature of the present invention to provide such an article which may be used with a variety of finishing products and techniques including acrylic paints, outdoor paints, water-based glaze, glitter, marbelizing, antiquing, stone texturizing, crackle finish, wood finish, metallic finish, gold leafing and patinas.

It is a further objective of the present invention to provide such an article of manufacture which permits the person suspending the article, even if not skilled, to obtain a secure support for the article and a level relationship of the article to the ground.

It is a further objective of the present invention to provide such an article which permits adjustment of the distance from which the article is suspended without removal of the article from the post, tree or other object from which it is suspended.

It is a further objective of the present invention to provide such an article which may be suspended from various types of supporting structures including a post, a tree, a hook, a patio railing, a fence, and a trellis.

It is a further objective of the present invention to provide such an article which is especially designed for use with a variety of swing means, including rope, cord, and metal cable.

It is a feature of the present invention to provide an article of manufacture, preferably hand cast from a cement derivative or formed from pre-cast gypsum plaster, and adapted to swing from a supporting structure. The article has a base having at least two base holes extending therethrough, a body in the shape of a figure connected to the base having at least two body holes therethrough aligned with the base holes, and swing means for suspending the article from the supporting structure. For example, the article may be in the shape of an animal such as a frog or a pair of kittens and suspended from a tree or a post.

The base has top and bottom surfaces comprising first and second rectilinear parallel sides and third and fourth sides transverse to the rectilinear sides. The third and fourth sides, which may be straight or curved, are joined with the rectilinear sides at points which form imaginary juncture lines with the rectilinear sides. Each of the body holes have an upper portion and a lower portion with the lower portions of the holes disposed in a horizontal plane parallel to the top and bottom surfaces of the base. Preferably the base holes are spaced a first distance from each other, the lower portions of the body holes are spaced a second distance from each other, and the ratio of the first distance to the second distance is in the range of 0.9:1.0 to 1.0:1.0. The swing means, for example a rope, cord or metal cable, passes through the base holes and the body holes to permit swinging movement of the article and to provide, along with the base and body, the appearance of a figure on a swing.

It is a further feature of the present invention to provide a method of providing the appearance of a figure on a swing. The method includes providing an article of manufacture comprising a base, a body in the shape of a figure connected to the base, and swing means for suspending the article from a supporting structure, providing at least two base holes in the base extending therethrough and at least two body holes in the body extending therethrough aligned with the base holes, and passing the swing means through the base holes and the body holes and suspending the swing means on the supporting structure to permit swinging movement of the article and provide the appearance of a figure on a swing.

SUMMARY OF THE INVENTION

The invention relates to an article of manufacture adapted to swing from a supporting structure and to a method of providing the appearance of a figure on a swing. The article, which is preferably hand cast or formed from concrete or concrete derivatives, has a body in the shape of a figure connected to a base with top and bottom surfaces including two rectilinear sides which are parallel to each other and two transverse sides having imaginary juncture lines with the rectilinear sides. Both the body and the base have at least two holes and the lower portion of the body holes are disposed in a horizontal plane parallel to the top and bottom surfaces of the base. The holes permit a user, for example a homeowner interested in saving garden space, to pass a swing means such as a rope through the holes to suspend the article from a supporting structure, to permit swinging movement of the article and to provide the appearance of a figure on a swing.

Additional details of the invention are contained in the following detailed description and the attached drawings, in which preferred embodiments are illustrated by way of example.

BRIEF DESCRIPTION OF THE DRAWINGS

Other objects and features of the present invention become apparent from the following detailed description considered in conjunction with the accompanying drawings.

It should be understood, however, that the drawings are designed for the purpose of illustration only and not as a definition of the limits of the invention.

In the drawings, wherein similar reference characters denote similar elements throughout the several views:

FIG. 1A is a front elevation view of an embodiment of the present invention wherein the figure is in the shape of a frog;

FIG. 1B is a front elevation view of an embodiment of the present invention wherein the figure is in the shape of a Franciscan friar;

FIG. 2 is a top view of the embodiment of FIG. 1A;

FIG. 3 is a left side view of the embodiment of FIG. 1A;

FIG. 4 is a rear view of the embodiment of FIG. 1A;

FIG. 5 is a bottom view of the embodiment of FIG. 1A;

FIG. 6 is a perspective view of the embodiment of FIG. 1A; and

FIG. 7 is a perspective view of additional embodiments of the invention in which the figure is in the shape of a variety of animals including a squirrel, a pair of kittens, and a pig.

DETAILED DESCRIPTION OF PREFERRED EMBODIMENTS

The article of manufacture of the present invention is preferably hand cast from a cement derivative so that it is weather resistant. Alternately, the article may be formed from wood, plastic, ceramic, aluminum, resin or other suitable preferably light weight and inexpensive material. For example, the article may be formed from pre-cast gypsum plaster. The article may be finished with any acrylic paint, outdoor paint, water-based glaze or glitter or finished with a variety of material and techniques including marbleizing, antiquing, stone texturing, crackle finishing, wood finishing, metallic finishing, gold leafing and patinas. In addition, the article may be left unfinished.

Figure 1B:
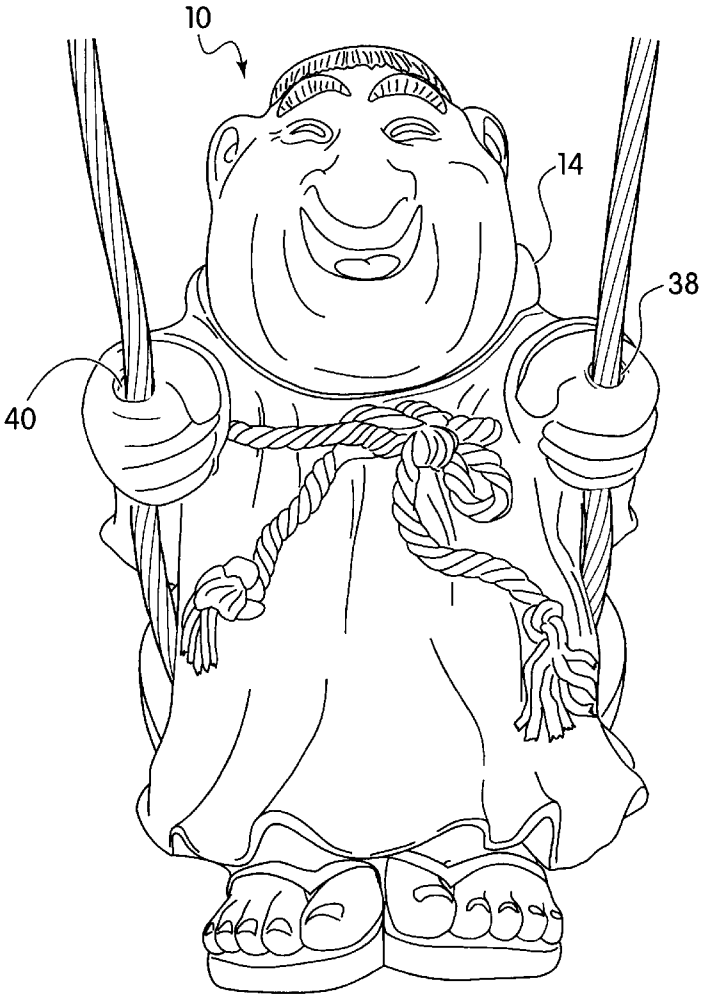
Figure 7:
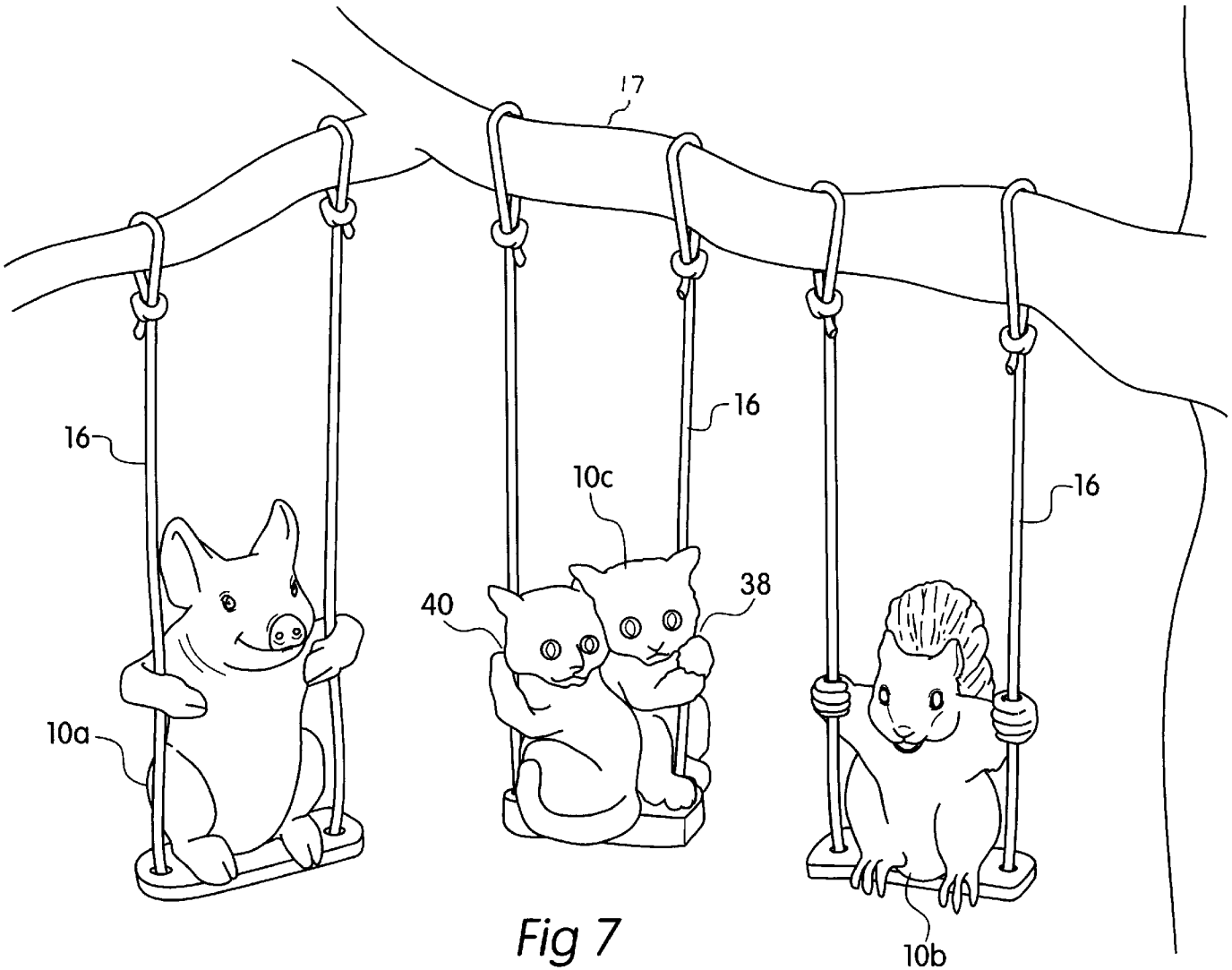

Turning now in detail to the drawings, FIGS. 1A and 2–6 show a first embodiment of the article 10 which comprises a base 12, a body 14 in the shape of a figure, for example a frog as shown or a kitten, person or other figure, preferably standing or sitting, connected to base 12, and swing means in the form of a rope 16. Body 14 may also be in the form of a Franciscan friar as shown in FIG. 1B or a variety of other figures such as a squirrel 10*b*, a pair of kittens 10*c*, and a pig 10*a* as shown in FIG. 7, and also a turtle, a bunny, a fish, and a Cupid.

Preferably article 10 is 5 to 10 inches in height with the height depending on the particular figure chosen and the preferences of the manufacturer, seller or user. For example, where the figure is in the form of pig 10*a*, the article can be 9 inches in height; when in the form of squirrel 10*b*, 7.25 inches in height; and when in the form of a pair of kittens 10*c*, 7.75 inches in height. See FIG. 7.

Figure 1A:
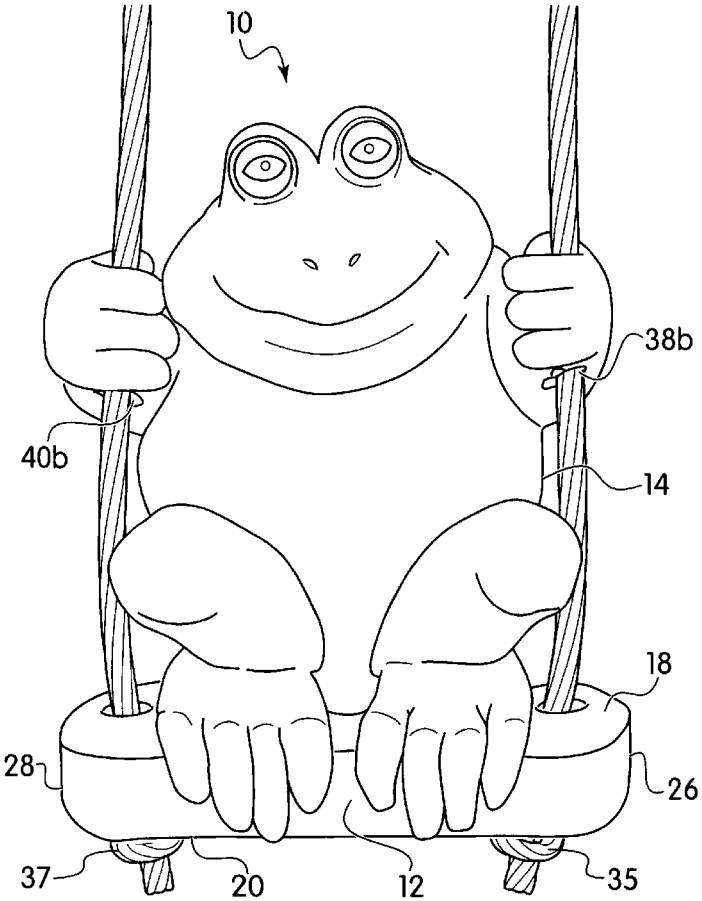

Base 12 has top and bottom surfaces 18,20 comprising first and second rectilinear parallel sides 22,24 and third and fourth sides 26,28, which may be straight or curved as shown in FIG. 1A, transverse to sides 22,24. First and second rectilinear sides 22,24 are joined with third and fourth transverse sides 26,28 at points 27*a*,27*b* and 29*a*,29*b* which form imaginary juncture lines 30,32. For example, base 12 may be formed as a unitary structure and a conceptual line may be drawn on each side of base 12 where a transverse side 26,28 connects with rectilinear sides 22,24.

Base 12 has at least two round base holes 34,36 extending therethrough. Body 14 has at least two round body holes 38,40 extending through body 14, preferably through the hands of the figure, aligned with base holes 34, 36. Each body hole 38,40 has an upper portion 38*a*,40*a* and a lower portion 38*b*,40*b*. Lower portions 38*b*,40*b* of body holes 38,40 are disposed in a horizontal plane parallel to top and bottom surfaces 18,20 of base 12. When the body is in the shape of two figures (see FIG. 7), it is preferable that one of the body holes, for example body hole 38, extends through one of the figures and the other body hole 40 extends through the other figure. Preferably base holes 34,36 are spaced a first distance from each other, for example 3.75 inches from their imaginary centers, body holes 38,40 are spaced a second distance from each other when measured from their lower portions 38*b*,40*b*, for example also 3.75 inches, and the ratio of the first distance to the second distance is in the range of 0.9:1.0 to 1.0:1.0.

Figure 4:
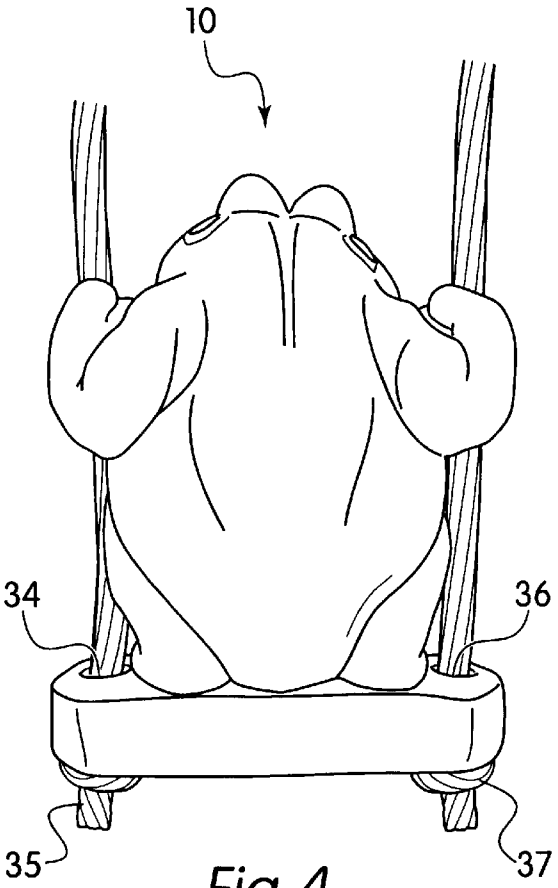
Figure 3:
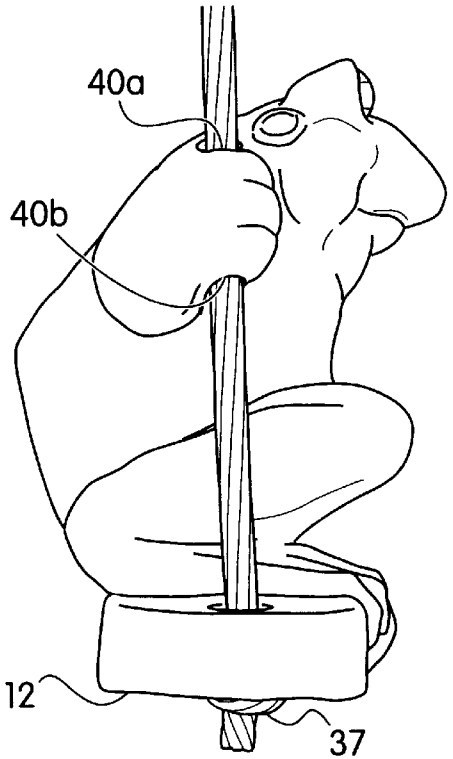
Figure 2:
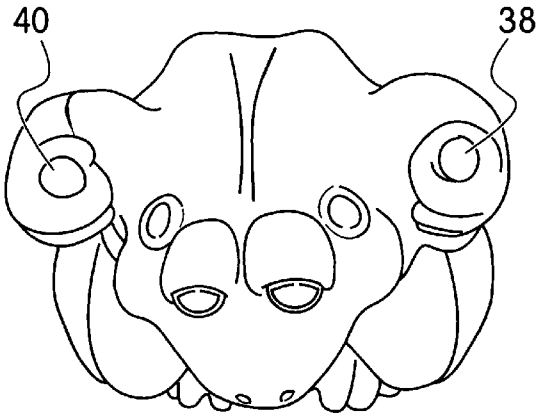
Figure 6:
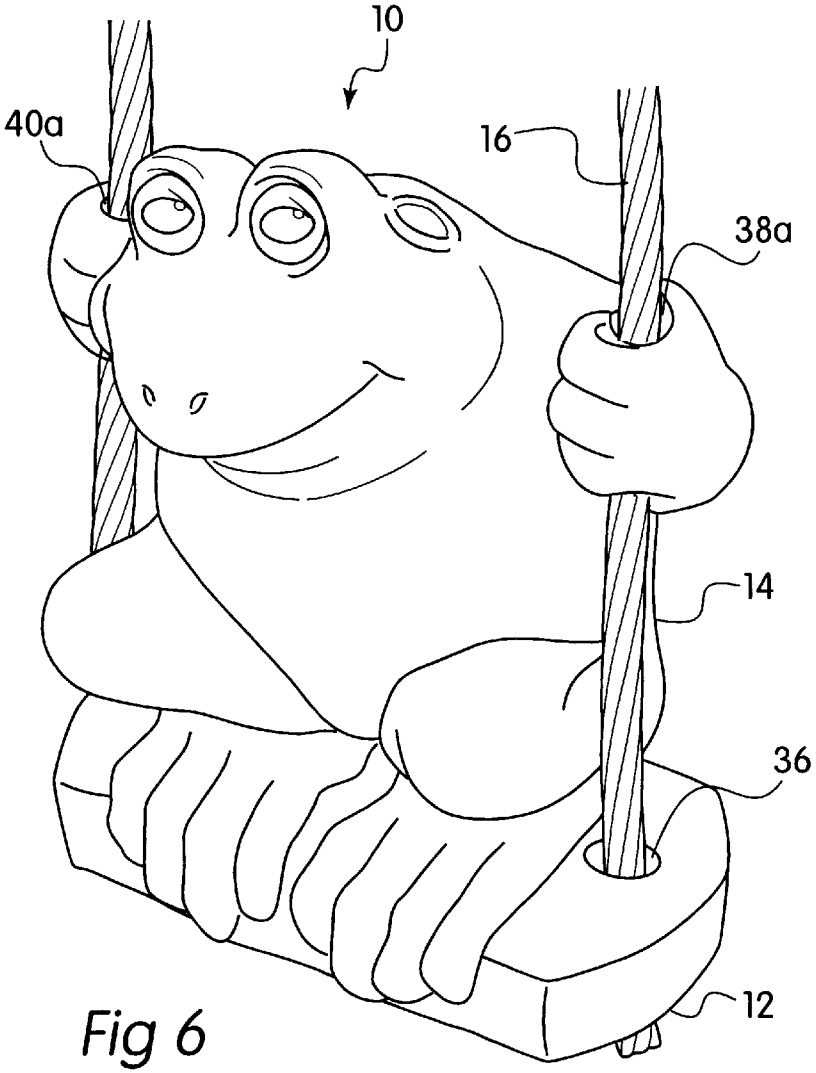
Figure 5:
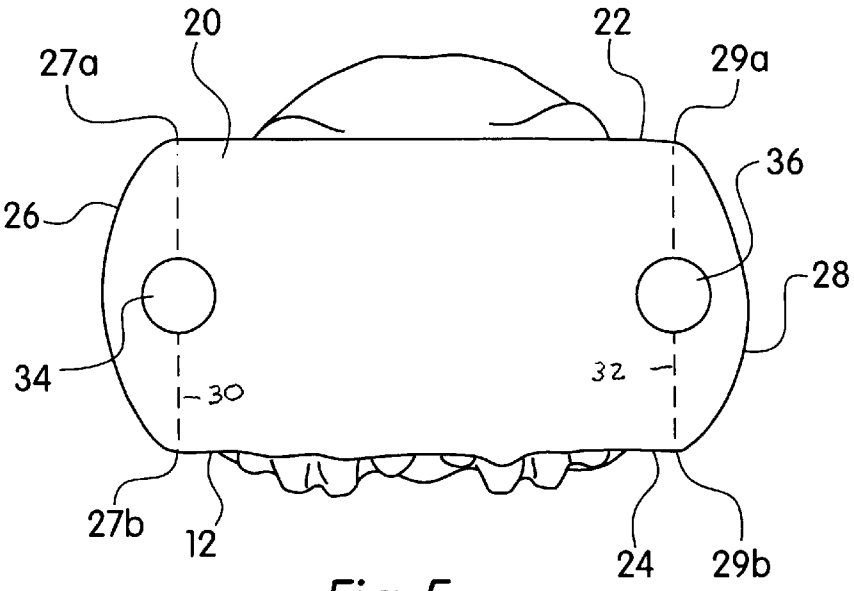

Swing means 16 passes through base holes 34,36 and body holes 38,40 so as to permit swinging movement of article 10 when suspended from tree limbs, wrought iron shepherds hooks, doorways, trellises, porches, patios, posts or other supporting structure 17. Preferably swing means 16 is outdoor rope, cord, or metal cable. For example, swing means may be an electric cable that provides electricity to a light fixture affixed to article 10 to provide illumination to a patio or garden. Preferably, swing means 16 is looped around the supporting structure and whose two ends are secured, for example by tying knots 35,37, at the bottom of base holes 34,36 respectively, as shown in FIGS. 1A, 3 and 4. Alternatively, swing means 16 may be arranged so that each end is secured around supporting structure 17. See FIG.7. When thus suspended by swing means 16 which allows for movement, base 12, body 14 and swing means 16 provide the illusion or appearance of an animal or other figure swinging on a swing.

Typical and preferred dimensions: height of article 10 is 6 inches; base 12 is 5 inches by 2.5 inches with top and bottom surfaces 18,20 separated from each other by 0.75 inches, first and second rectilinear sides 22,24 each being 4 inches, third and fourth transverse sides 26,28 being curved as shown in FIG. 1A, and base holes 34,36 being disposed 0.75 inches from the apex of the curve of transverse sides 26,28; lower portions 38*b*,40*b* of body holes 38,40 are spaced 3.75 inches from each other in a horizontal place and are each 3 inches from top surface 18 of base 12; upper portions 38*a*,40*a* of body holes 38,40 are each 4 inches from top surface 18 of base 12; swing means 16 is 144 inches (12 feet) in length. However, larger and smaller dimensions may be used depending on the preferences of the manufacturer, seller, or user.

In accordance with the method of the present invention, the appearance of a figure on a swing is provided by forming base 12 and body 14 of article 10, preferably as a unitary structure hand cast or formed from concrete or concrete derivatives, and providing at least two base holes 34,36 and at least two body holes 38,40, aligned with base holes 34,36 on opposite sides, extending through base 12 and body 14 respectively.

Base 12 has top and bottom surfaces 18,20 comprising first and second rectilinear parallel sides 22,24 and third and fourth sides 26,28 transverse to sides 22,24 and being joined with sides 22,24 at points forming imaginary juncture lines with them. Swing means 16 is passed through base holes 34,36 and body holes 38,40 and suspended on a supporting structure such as a post, a tree, a hook, a patio railing, a fence, and a trellis to permit swinging movement of article 10 and provide the appearance of a figure on a swing.

By the use of the invention, a person suspending the article, even if not skilled, is able to obtain a secure support for the article simply by looping the rope, cord, metal cable or other swing means over an available structure, such as a tree branch, and obtain a level relationship of the article to the ground. The distance from which the article is suspended may be readily and easily adjusted without removal of the article from the tree or post, for example by simply adjusting the knots at the ends of the rope, cord, or cable to lengthen or shorten the length of the swing means, enabling the article to be placed at different levels.

By suspending the article from a supporting structure, homeowners may use the article to give a different look to gardens, patios, and backyards with limited space and without damaging plants or taking up soil space where plants would otherwise grow or patio space where planters or other articles would otherwise be placed. The invention also provides a unique way to display outdoor statuary.

The swinging motion serves to repel animals and birds from approaching a garden. For example, the motion of a figure in the shape of an owl may be used to scare away birds for whom owls are natural predators. Even if the figure is in the shape of another animal, the motion may cause animals such as birds to fear that danger exists in approaching the backyard.

While several embodiments of the present invention have been shown and described, it is to be understood that many changes and modifications may be made thereunto without departing from the spirit and scope of the invention as defined in the appended claims.

What is claimed is:

1. An article of manufacture adapted to swing from a supporting structure comprising:

(a) a base having top and bottom surfaces comprising first and second rectilinear parallel sides and third and fourth sides transverse to the rectilinear sides, said third and fourth sides being joined with said rectilinear sides at points forming imaginary juncture lines with the rectilinear sides, said base having at least two base holes therethrough;

(b) a body in the shape of a figure connected to the base, said body having at least two body holes therethrough aligned with the base holes, each of said body holes having an upper portion and a lower portion, said lower portions of the holes being disposed in a horizontal plane parallel to the top and bottom surfaces of the base; and (c) swing means for suspending said article from the supporting structure, said swing means passing through said base holes and said body holes to permit swinging movement of the article, said base, body and swing means providing the appearance of a figure on a swing.

2. An article vehicle as in claim 1 wherein said body is in the shape of two figures, one of said body holes extending through one of the figures and another of said body holes extending through the other figure.

3. An article as in claim 1 wherein said third and fourth sides are curved.

4. An article as in claim 1 wherein said third and fourth sides are straight.

5. An article as in claim 1 wherein the base holes are spaced a first distance from each other, the lower portions of the body holes are spaced a second distance from each other, and the ratio of the first distance to the second distance is in the range of 0.9:1.0 to 1.0:1.0.

6. An article as in claim 1 wherein the article is formed from concrete or concrete derivatives.

7. An article as in claim 1 wherein the figure is in the shape of an animal.

8. An article as in claim 1 wherein the figure is selected from the group consisting of a frog, a kitten, a pig, a squirrel, a Franciscan friar, a turtle, a bunny, a fish, a Cupid, and an owl.

9. An article as in claim 1 wherein the swinging means is selected from the group consisting of rope, cord, and metal cable.

10. A method of providing the appearance of a figure on a swing comprising:

(a) providing an article of manufacture comprising a base, a body in the shape of a figure connected to the base, and swing means for suspending said article from a supporting structure, said base having top and bottom surfaces comprising first and second rectilinear parallel sides and third and fourth sides transverse to the rectilinear sides, said third and fourth sides being joined with said rectilinear sides at points forming imaginary juncture lines with the rectilinear sides;

(b) providing at least two base holes in said base extending therethrough and at least two body holes in said body extending therethrough aligned with the base holes, each of said body holes having an upper portion and a lower portion, said lower portions of the holes being disposed in a horizontal plane parallel to the top and bottom surfaces of the base; and (c) passing said swing means through said base holes and said body holes and suspending said swing means on the supporting structure to permit swinging movement of the article and provide the appearance of a figure on a swing.

11. A method as in claim 10 wherein the supporting structure is selected from the group consisting of a post, a tree, a hook, a doorway, a porch, a patio railing, a fence, and a trellis.

* * * * *